US010030676B2

(12) United States Patent
Sifri et al.

(10) Patent No.: US 10,030,676 B2
(45) Date of Patent: Jul. 24, 2018

(54) HYDRAULIC FLUID SUPPLY APPARATUS AND METHODS

(71) Applicant: NACCO Materials Handling Group, Inc., Fairview, OR (US)

(72) Inventors: Maurice Sifri, Gresham, OR (US); Chikka Rao, Happy Valley, OR (US); Tory Hoff, Portland, OR (US)

(73) Assignee: HYSTER—YALE GROUP, INC., Fairview, OR (US)

( * ) Notice: Subject to any disclaimer, the term of this patent is extended or adjusted under 35 U.S.C. 154(b) by 437 days.

(21) Appl. No.: 14/694,105

(22) Filed: Apr. 23, 2015

(65) Prior Publication Data

US 2015/0308464 A1 Oct. 29, 2015

Related U.S. Application Data

(60) Provisional application No. 61/983,345, filed on Apr. 23, 2014.

(51) Int. Cl.

| | |
|---|---|
| ***E03B 7/07*** | (2006.01) |
| ***F15B 1/26*** | (2006.01) |
| ***B66F 9/22*** | (2006.01) |
| ***E02F 9/08*** | (2006.01) |
| ***B66F 9/075*** | (2006.01) |

(52) U.S. Cl.

CPC ..... *F15B 1/26* (2013.01); *B66F 9/07518* (2013.01); *B66F 9/22* (2013.01); *E02F 9/0883* (2013.01)

(58) Field of Classification Search

CPC ..... F15B 1/26; B66F 9/07518; B66F 9/22; E02F 9/0883; E02F 9/0841; E02F 9/22; E02F 3/961

See application file for complete search history.

(56) References Cited

U.S. PATENT DOCUMENTS

| | | | | |
|---|---|---|---|---|
| 2,059,716 A | | 11/1936 | Swinburne | |
| 3,604,205 A | | 9/1971 | H et al. | |
| 3,606,051 A | * | 9/1971 | Peterson | E02F 3/961 414/697 |
| 3,709,100 A | * | 1/1973 | Peterson | F15B 1/26 91/189 R |
| 3,960,174 A | | 6/1976 | Latimer et al. | |
| 4,241,578 A | | 12/1980 | Keene | |
| 4,255,091 A | * | 3/1981 | Dike, Jr. | F15B 1/26 417/313 |
| 5,666,295 A | | 9/1997 | Bruns | |
| 5,709,085 A | | 1/1998 | Herbig | |

(Continued)

FOREIGN PATENT DOCUMENTS

| | | |
|---|---|---|
| GB | 1302437 B | 1/1973 |
| GB | 2419853 A | 5/2006 |

*Primary Examiner* — Reinaldo Sanchez-Medina

(74) *Attorney, Agent, or Firm* — Schwabe Williamson & Wyatt

(57) ABSTRACT

Commonly available industrial vehicles may be constructed with a frame originally designed for a particular fuel source where such a frame is used to construct an industrial vehicle that uses a different fuel source with a different fuel storage compared to the industrial vehicle for which such a frame was originally intended. Such a truck powered by a different fuel source typically includes an empty space that was originally intended to house the original fuel, and such empty space may be used to increase the hydraulic storage capacity for such a truck.

6 Claims, 1 Drawing Sheet

(56) References Cited

U.S. PATENT DOCUMENTS

| | | | | |
|---|---|---|---|---|
| 5,881,753 | A | 3/1999 | Bowling | |
| 6,189,636 | B1 | 2/2001 | Kikukawa | |
| 8,128,377 | B2 | 3/2012 | Earhart et al. | |
| 2001/0015129 | A1* | 8/2001 | Altman | B66F 9/22 91/525 |
| 2001/0030085 | A1* | 10/2001 | Nagata | B62D 5/065 187/222 |
| 2002/0001516 | A1* | 1/2002 | Cook | B66F 9/0655 414/685 |
| 2003/0167114 | A1* | 9/2003 | Chen | B66F 9/22 701/50 |
| 2004/0016601 | A1 | 1/2004 | Brouillet | |
| 2008/0095578 | A1 | 4/2008 | Farber et al. | |
| 2009/0158728 | A1 | 6/2009 | Harsia | |
| 2012/0247324 | A1 | 10/2012 | Kramer et al. | |

* cited by examiner

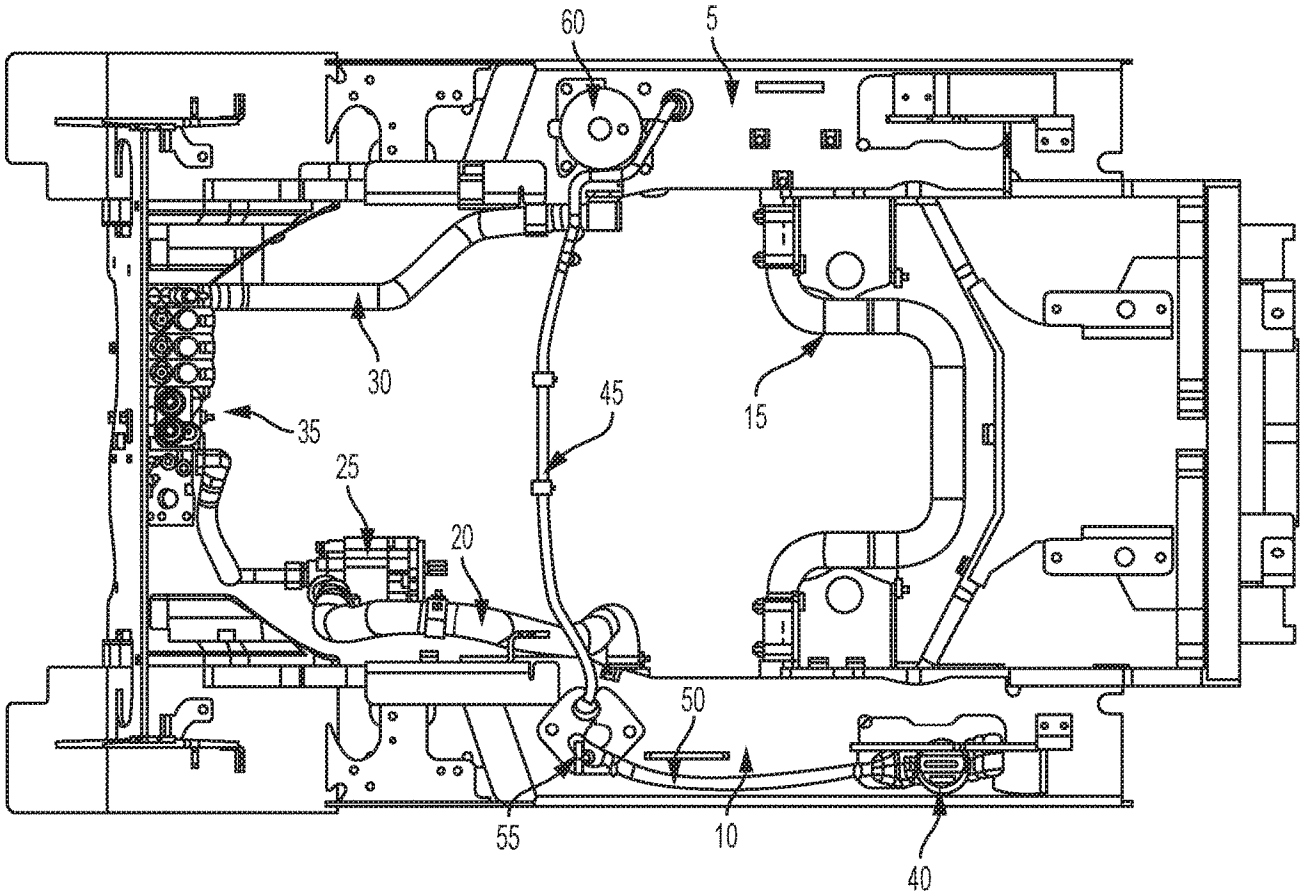
5
60
15
45
30
35
25
20
50
55
10
40

HYDRAULIC FLUID SUPPLY APPARATUS AND METHODS

PRIOR APPLICATIONS

The present application claims priority to U.S. Provisional Patent Application No. 61/983,345 titled "Hydraulic Fluid Supply Apparatus And Methods" and filed on 23 Apr. 2014, which is fully incorporated by reference herein.

TECHNICAL FIELD

The present invention relates to hydraulic circuits for industrial vehicles.

BACKGROUND

Hydraulic circuits, such as hydraulic circuits for industrial vehicles, typically include a tank to store hydraulic fluid. A general guideline for sizing such a tank is to provide a tank volume that is approximately two to four times the gallon or liter per minute pumping capacity of the pump in the hydraulic circuit. Some hydraulic circuits may require a tank with more volume, while a tank with less volume may be adequate for other hydraulic circuits.

SUMMARY

Commonly available industrial vehicles may be constructed with a frame originally designed for a particular fuel source where such a frame is used to construct an industrial vehicle that uses a different fuel source with a different fuel storage compared to the industrial vehicle for which such a frame was originally intended. Such a truck powered by a different fuel source typically includes an empty space that was originally intended to house the original fuel, and such empty space may be used to increase the hydraulic storage capacity for such a truck.

BRIEF DESCRIPTION OF THE DRAWINGS

FIG. 1 is a schematic illustration of an exemplary hydraulic circuit comprising two storage tanks.

DETAILED DESCRIPTION

The present inventors have recognized that existing industrial trucks comprising a hydraulic circuit, such as a fork lift truck, may not have sufficient space to provide a hydraulic tank with a volume that is approximately two to four times the gallon or liter per minute pumping capacity of the pump in the hydraulic circuit. The present inventors have also recognized that such lack of volume for the hydraulic tank may make cooling the hydraulic fluid difficult because hydraulic fluid may not stay in the tank for an adequate time to permit sufficient cooling via contact with the tank walls before being recirculated by the pump.

The present inventors have recognized that commonly available industrial vehicles, for example, fork lift trucks, equipped with hydraulic systems may have hydraulic fluid storage capabilities that are not optimized for pumping capacities, hydraulic flow rates, or both. The present inventors have recognized that space constraints associated with commonly available industrial vehicles may limit the volume available for hydraulic fluid storage.

The present inventors have also recognized that commonly available industrial vehicles may be constructed with a frame originally designed for a particular fuel source where such a frame is used to construct an industrial vehicle that uses a different fuel source with a different fuel storage compared to the industrial vehicle for which such a frame was originally intended. For example, a frame originally designed for a fork lift truck powered by a gasoline combusting engine and having a gasoline tank in the frame may be used to construct a similar fork lift truck that is powered by a liquid natural gas ("LNG") combusting engine that includes a LNG cylinder mounted externally of the frame. The present inventors have recognized that such a truck powered by LNG typically includes an empty space that was originally intended to house a gasoline tank for a gasoline powered truck.

Accordingly, in one embodiment, a space or volume of a frame originally intended for a feature of an industrial vehicle that will not be included for a similar industrial vehicle that uses the same frame is identified. Such an identified space or volume is modified to house a second hydraulic fluid storage tank that is connected to another, pre-existing, hydraulic fluid storage tank such that hydraulic fluid communicates between the original hydraulic fluid storage tank and the second hydraulic fluid storage tank.

For ease of reference, the original hydraulic fluid storage tank 5 and the second hydraulic fluid storage tank 10 are specified in FIG. 1, however, which hydraulic fluid storage tank is the original hydraulic fluid storage tank and which is the second hydraulic fluid storage tank is not important.

In the embodiment illustrated in FIG. 1, a first fluid conduit 15 communicates hydraulic fluid between the original hydraulic fluid storage tank 5 and the second hydraulic fluid storage tank 10. A second fluid conduit 20 communicates hydraulic fluid from the second hydraulic fluid storage tank 10 to a hydraulic pump 25 that pressurizes the hydraulic fluid. A third fluid conduit 30 communicates hydraulic fluid to the original hydraulic fluid storage tank 5 after the pressurized hydraulic fluid has been used by a vehicle component, such as hydraulic equipment generally designated as 35.

Preferably, the second hydraulic fluid storage tank 10 communicates with atmospheric pressure, for example, via a breather 40. A fourth fluid conduit 45 preferably communicates air pressure between the original hydraulic fluid storage tank 5 and the second hydraulic fluid storage tank 10. A fifth fluid conduit 50 preferably communicates air pressure between the breather 40 and an optional dip-stick structure 55 used to assess the fluid level in the second hydraulic fluid storage tank 10, add hydraulic fluid to the second hydraulic storage tank 10, or both.

In one embodiment, the first fluid conduit 15 has a relatively large diameter, for example, in the range of 38 millimeters (mm) to 52 mm, to facilitate hydraulic fluid flow between the original hydraulic fluid storage tank 5 and the second hydraulic fluid storage tank 10. For example, including a relatively large diameter for the first fluid conduit 15 may decrease the pressure loss resulting from hydraulic fluid flowing through the first fluid conduit 15 compared against having a first fluid conduit 15 with a relatively small diameter.

In operation, hydraulic fluid is drawn from the second hydraulic fluid storage tank 10 by the hydraulic pump 25 via second fluid conduit 20. Pressurized hydraulic fluid is used by the component 35 and is returned via the third fluid conduit 30 to the original hydraulic fluid storage tank 5. Optionally, returning hydraulic fluid enters the original hydraulic fluid storage tank 5 at a location between the bottom of the hydraulic fluid storage tank 5 and the top of the hydraulic fluid storage tank 5 that is closer to the bottom of the hydraulic fluid storage tank 5. An optional return filter 60 located in the original hydraulic fluid storage tank 5 may be included to facilitate removing particles from the hydraulic fluid, in which case the returning hydraulic fluid may be routed through the filter 60 before being routed toward the bottom of the hydraulic fluid storage tank 5.

Typically, hydraulic fluid flowing into the original, or first, hydraulic storage tank 5 creates a relatively small pressurization of the hydraulic tank 5, preferably in the range of approximately 0 pounds per square inch ("psi") to approximately 8 psi. For example, pressurization may occur because of the remaining pressurization of the hydraulic fluid after use by the component 35. Pressurization of the first hydraulic storage tank 5 is preferably limited by permitting air to flow from the first hydraulic storage tank 5 to the second hydraulic storage tank 10 via the fourth fluid conduit 45. The inner diameter of the fourth fluid conduit 45 is preferably sized with respect to one or more of an average, maximum, or other suitable fluid flow rate for the fluid entering the first hydraulic storage tank 5 via the fluid conduit 30 such that pressurization of the first hydraulic storage tank 5 does not exceed a predetermined pressurization, or pressure.

Such pressurization of the first hydraulic storage tank 5 may cause hydraulic fluid to flow from the first hydraulic storage tank 5 to the second hydraulic storage tank 10 via the first fluid conduit 15. However, hydraulic fluid may enter the first hydraulic storage tank 5 via the third fluid conduit 30 faster than hydraulic fluid exits the first hydraulic storage tank 5 via the first fluid conduit 15. In the event that the first hydraulic storage tank 5 becomes full of hydraulic fluid, hydraulic fluid may flow from the first hydraulic storage tank 5 to the second hydraulic storage tank 10 via the first fluid conduit 15 and the fourth fluid conduit 45 while air is pushed from the second hydraulic storage tank 10 to the atmosphere via the fifth fluid conduit 50 and the breather 40. Preferably, the first fluid conduit 15, the fourth fluid conduit 45, and the fifth fluid conduit 50 have inner diameters that are sized to prevent pressurization of the first hydraulic storage tank 5 from exceeding the predetermined pressurization for a predetermined volume of the first hydraulic storage tank 5 and a predetermined rate of hydraulic fluid flow through the third fluid conduit 30.

In an exemplary embodiment, the pump 25 has a flow rate of 110 liters per minute, the first hydraulic storage tank 5 has a volume of 34 liters, the second hydraulic storage tank 10 has a volume of 34 liters, the first fluid conduit 15 has an inner diameter of 47.5 mm, the second fluid conduit 20 has an inner diameter of 38.1 mm, the third fluid conduit 30 has an inner diameter of 31.8 mm, the fourth fluid conduit 45 has an inner diameter of 15.9 mm, and the fifth fluid conduit 50 has an inner diameter of 12.7 mm. The breather 40 for such an exemplary embodiment is a model BF30 manufactured by Hydac Technology Corporation of Vancouver, Wash.

For the exemplary embodiment described in the preceding paragraph, a predetermined pressurization of 8 psi is maintained for the first hydraulic storage tank 5, which has a predetermined volume of 34 liters. The predetermined flow rate for the third fluid conduit 30 is 223 liters per minute, and is a maximum flow rate for the inner diameter of 31.8 mm of the third fluid conduit 30, such that the predetermined pressurization of 8 psi is not exceeded for the first hydraulic storage tank 5 during operation of the system.

The foregoing is a detailed description of illustrative embodiments of the invention using specific terms and expressions. Various modifications and additions can be made without departing from the spirit and scope thereof. Therefore, the invention is not limited by the above terms and expressions, and the invention is not limited to the exact construction and operation shown and described. On the contrary, many variations and embodiments are possible and fall within the scope of the invention which is defined only by the claims that follow.

The invention claimed is:

1. An industrial vehicle, comprising:

a component operated by pressurized hydraulic fluid; and a hydraulic circuit configured to supply the pressurized hydraulic fluid to the component, the hydraulic circuit comprising;

a first hydraulic storage tank configured to be pressurized to a predetermined pressure that is greater than atmospheric pressure surrounding the industrial vehicle;

a second hydraulic storage tank configured to be pressurized to the atmospheric pressure surrounding the industrial vehicle;

a pump, wherein the pump pressurizes hydraulic fluid to generate the pressurized hydraulic fluid with a first pressure greater than a second pressure of the hydraulic fluid, wherein the pump supplies the pressurized hydraulic fluid to the component and wherein the hydraulic fluid exits the component with the second pressure;

a first fluid conduit connected between the first hydraulic storage tank and the second hydraulic storage tank and located to communicate the hydraulic fluid between the first hydraulic storage tank and the second hydraulic storage tank;

a second fluid conduit connected between the second hydraulic storage tank and the pump and configured to communicate the hydraulic fluid from the second hydraulic storage tank to the pump;

a third fluid conduit connected between the component and the first hydraulic storage tank and configured to communicate the hydraulic fluid from the component to the first hydraulic storage tank;

a fourth fluid conduit connected between the first hydraulic storage tank and the second hydraulic storage tank and located to primarily communicate air between the first hydraulic storage tank and the second hydraulic storage tank and to secondarily communicate the hydraulic fluid between the first hydraulic storage tank and the second hydraulic storage tank; and a fifth fluid conduit connected between the second hydraulic storage tank and a breather communicating with the atmosphere surrounding the vehicle and configured to communicate air between the second hydraulic storage tank and the breather such that the first storage tank substantially maintains the predetermined pressure.

2. An industrial vehicle according to claim 1, wherein the first fluid conduit, the fourth fluid conduit, and the fifth fluid conduit have respective inner diameters that are sized such that pressurization of the first hydraulic storage tank does not exceed the predetermined pressure, and wherein the predetermined pressure is based on a predetermined volume of the first hydraulic storage tank and a predetermined rate of fluid flow through the third fluid conduit.

3. An industrial vehicle according to claim 2, wherein the predetermined pressure is 8 psi.

4. An industrial vehicle according to claim 3, wherein:

the predetermined volume of the first hydraulic storage tank is 34 liters; and the predetermined rate of fluid flow through the third fluid conduit is 223 liters per minute.

5. An industrial vehicle according to claim 4 wherein an inner diameter of the first fluid conduit is 47.5 mm, an inner diameter of the fourth fluid conduit is 15.9 mm, and an inner diameter of the fifth fluid conduit is 12.7 mm.

6. An industrial vehicle according to claim 1 wherein the industrial vehicle comprises a fork lift truck.

* * * * *